United States Patent [19]

Kawashima et al.

[11] Patent Number: 4,815,943

[45] Date of Patent: Mar. 28, 1989

[54] VARIABLE DISPLACEMENT WOBBLE PLATE COMPRESSOR WITH CAPACITY CONTROL VALVE

[75] Inventors: Kenichi Kawashima, Katsuta; Kenji Emi, Mito; Akira Tezuka; Kosaku Sayo, both of Katsuta; Toshikazu Ito, Toukai; Toshio Sudo, Katsuta; Yukio Takahashi, Katsuta; Isao Hayase, Katsuta; Atsushi Suginuma, Mito; Kiyosi Yamamoto, Ooarai; Hideo Usui, Katsuta; Kunihiko Takao, Chiyoda; Masao Mizukami, Katsuta; Masaru Ito, Katsuta; Masahiro Moritaka, Katsuta, all of Japan

[73] Assignee: Hitachi, Ltd., Tokyo, Japan

[21] Appl. No.: 102,656

[22] Filed: Sep. 30, 1987

[30] Foreign Application Priority Data

| | | | |
|---|---|---|---|
| Oct. 1, 1986 | [JP] | Japan | 61-231181 |
| Nov. 29, 1986 | [JP] | Japan | 61-285696 |
| Feb. 4, 1987 | [JP] | Japan | 62-22349 |
| Mar. 16, 1987 | [JP] | Japan | 62-58999 |
| Mar. 25, 1987 | [JP] | Japan | 62-69070 |

[51] Int. Cl.[4] ..... F04B 1/26

[52] U.S. Cl. ..... 417/222; 92/12.2; 417/269

[58] Field of Search ..... 417/222, 269, 270, 295, 417/312, 313; 92/12.2

[56] References Cited

U.S. PATENT DOCUMENTS

| | | | |
|---|---|---|---|
| 3,712,759 | 1/1973 | Olson, Jr. | 417/269 |
| 3,861,829 | 1/1975 | Roberts et al. | 417/270 X |
| 4,019,342 | 4/1977 | Ohta | 417/313 X |
| 4,037,993 | 7/1977 | Roberts | 417/222 |
| 4,073,603 | 2/1978 | Abendschein et al. | 417/222 |
| 4,105,370 | 8/1978 | Brucken et al. | 417/269 X |
| 4,145,163 | 3/1979 | Fogelberg et al. | 417/222 |
| 4,175,915 | 11/1979 | Black et al. | 417/222 |
| 4,178,136 | 12/1979 | Reid et al. | 417/269 |
| 4,297,085 | 10/1981 | Brucken | 417/222 |
| 4,428,718 | 1/1984 | Skinner | 417/222 |
| 4,526,516 | 7/1985 | Swain et al. | 417/222 |
| 4,669,272 | 6/1987 | Kawai et al. | 417/270 |
| 4,685,866 | 8/1987 | Takenaka et al. | 417/270 |

FOREIGN PATENT DOCUMENTS

| | | | |
|---|---|---|---|
| 55380 | 3/1986 | Japan | 417/222 |

*Primary Examiner*—William L. Freeh

*Attorney, Agent, or Firm*—Antonelli, Terry & Wands

[57] ABSTRACT

A variable displacement compressor comprises a housing forming a crank chamber, a shaft, expansible chambers including pistons, a swash plate connected to the shaft so as to be smoothly changeable in inclination against the shaft and driven to rotate, a wobble plate rotatable on the swash plate, a rotation preventing mechanism including a shoe member slidable in an axial direction, and a pressure control valve which is provided in a refrigerant passage from a suction port of the compressor to the expansible chamber to control the pressure of refrigerant to be sucked responsive to the suction pressure and both to the suction pressure and to the discharge pressure when the discharge pressure is high. The refrigerant passage has a sharply bent portion for separating lubrication oil from a refrigerant flowing therein and communicates with the crank chamber to discharge blow-by gas therefrom.

13 Claims, 12 Drawing Sheets

VARIABLE DISPLACEMENT WOBBLE PLATE COMPRESSOR WITH CAPACITY CONTROL VALVE

BACKGROUND OF THE INVENTION

This invention relates to a variable displacement compressor and, more particularly, to a variable displacement compressor with a compressor capacity control valve, which is suitable for rapid cooling of an automobile air conditioner.

In general, a conventional variable displacement compressor comprises a mechanism for converting rotating motion of a driving shaft into reciprocating motion of pistons of the compressor. The mechanism includes a rotating swash plate driven by the driving shaft and a wobble plate supported by the swash plate and connected to the pistons by connecting rods. The wobble plate is provided with a rotation preventing mechanism by which the wobble plate itself is prevented from rotating and provides only wobbling motion for reciprocating the pistons. The swash plate is pivotably supported by a driving member secured to the driving shaft so that it can change in inclination angle against the driving shaft. The change in the inclination angle causes change in piston stroke, whereby the compressor changes in capacity. The inclination angle of the swash plate is determined by pressure differential of refrigerant acting on both ends of respective pistons. The pressure differential is controlled by a compressor capacity control means not to unduly cool down the refrigerant, so that an evaporator will not be covered with frost.

A proposal of the compressor capacity control means is disclosed in U.S. Pat. No. 4,428,718 in which the compressor capacity or discharge volume is controlled in response to both the suction pressure and the discharge pressure thereof by increasing the pressure in the crank chamber through individual communication between the crank chamber and the suction cavity or the discharge cavity.

In this conventional method of controlling the compressor capacity, a discharged refrigerant is introduced into the crank chamber, so that an amount of blow-by gas substantially increases whereby the durability of the compressor is lowered because the lubrication oil in the crank chamber flows out into a refrigeration cycle without a suitable oil recovery means, and the compressor efficiency decreases. Further it is not taken into account that when atmospheric temperature decreases (to less than 5° C.), the discharge pressure also decreases (to less than 3 $kg/cm^2g$), so that a crank chamber pressure necessary to control the compressor capacity can not be obtained.

A part of the refrigerant returning from the refrigeration cycle to the compressor leaks from gaps between the cylinders and the pistons and enters the crank chamber as blow-by gas. It is necessary to discharge the blow-by gas out of the crank chamber for one reason to maintain the pressure in the crank chamber at a desired value. In this case, the lubrication oil mixes with the blow-by gas and the discharge of the blow-by gas is accompanied by outflow of the lubrication oil in the crank chamber, so that the lubrication oil decreases and the durability of the compressor is lowered.

A method for recovering lubrication oil flowing out into the refrigeration cycle is disclosed in SAE Technical Paper Series No. 850040 (1985) in which the lubrication oil mixed with the blow-by gas flowing into the crank chamber through gaps between the pistons and the cylinders is separated from the blow-by gas and stored in the crank chamber to use again as lubrication oil. An amount of the recovered lubrication oil is proportional to an amount of the blow-by gas. From the view point of lubrication, it is desirable to increase an amount of the blow-by gas, but the increase of the blow-by gas amount results in lowering the compressor performance.

In the variable displacement compressor, the inclination angle of the wobble plate is changed by a pressure differential between the pressure in the crank chamber and the pressure inside the cylinder, so that in case thermal load in the refrigeration cycle is small, the pressure differential is small, and an amount of the blow-by gas decreases, which is followed by a decrease in lubrication oil returning into the crank chamber.

Further, it is necessary that the wobble plate connected to the pistons through the connecting rods move smoothly to incline against the driving shaft in order to effectively achieve the function of the compressor capacity control means and to smoothly reciprocating the pistons. The compressor capacity control means produces controlled pressure differential, and it is necessary that the wobble plate assumes a correct inclination angle in response to the pressure differential. Therefore, the wobble plate rotation preventing mechanism and a pivotal connection between the swash plate and the driving member must to move smoothly.

SUMMARY OF THE INVENTION

An object of the invention is to provide a variable displacement compressor with a compressor capacity control valve or a pressure control valve, which compressor is able to effect rapid cooling while having high durability and reliability without lowering compressor efficiency thereof.

Another object of the invention is to provide a variable displacement compressor with a pressure control valve, which compressor is able to effect rapid cooling and effective recovery of lubrication oil from the refrigerant without being influenced by a decrease in an amount of blow-by gas in a period of time of low thermal load operation of the refrigeration cycle while having high durability and reliability.

The present invention resides in a variable displacement compressor comprising a plurality of expansible chambers including cylinders and pistons each of which has a front side end forming a part of the expansible chamber and a back side end, a driving shaft, means for converting rotation of the driving shaft into reciprocation of the pistons, the rotation converting means including means connected to the pistons for imparting reciprocation to the pistons, means for connecting reciprocation imparting means to the driving shaft so that the reciprocation imparting means is driven to rotate by the driving shaft while being allowed to incline freely against the driving shaft, and means for preventing a part of the reciprocation imparting means from rotating to wobble, thereby reciprocating the pistons, housing means for forming a crank chamber enclosing therein the rotation converting means and at least the back side end of each of the pistons, a refrigerant suction port through which a refrigerant is led to the expansible chambers under suction stroke, a refrigerant discharge port communicating with the expansible chambers to discharge compressed refrigerant, a pressure control valve provided to control pressure of a refrigerant to be sucked into the expansible chambers under suction stroke in response to refrigerant suction pressure on the upstream side of the pressure control valve and a discharge pressure so that a control pressure is small when the discharge pressure is high, thereby changing an amount of compressed refrigerant discharged from the expansible chambers, that is, the compressor capacity, and a passage for communicating the crank chamber and a refrigerant passage on the upstream side of the pressure control valve thereby to allow blow-by gas in the crank chamber to flow out thereof.

The variable displacement compressor is most suitable in use for an automobile or car air conditioner employing refrigeration cycle. The refrigeration cycle includes a condenser for condensing compressed refrigerant from the compressor, an expansion valve, and an evaporator with fins for evaporating condensate of the refrigerant by air flow. The compressor sucks the gas from the evaporator into the expansible chambers under suction stroke through the refrigerant suction port of the compressor.

In the variable displacement compressor, pressure of refrigerant to be sucked into the expansible chambers is directly controlled by the pressure control valve, and the compressor capacity is controlled by pressure differential between the pressure on the upstream side of the pressure control valve and the pressure on the downstream side thereof, so that the responsibility of control is raised. The compressor capacity control is to prevent the evaporator fins from being deposited by frost through control of the pressure of refrigerant to be sucked into the expansible chambers. Therefore, when R-12 is used as a refrigerant for the compressor, control pressure by the pressure control valve is about 1.9 $kg/cm^2g$ and the minimum pressure which the refrigerant on the downstream side of the pressure control valve can reach to is $-1.0$ $kg/cm^2g$, so that pressure which can be available to control the compressor capacity becomes large and about 2.9 $kg/cm^2g$, whereby the compressor capacity control can be effected even at atmospheric temperature of lower than 0° C.

On the other hand, the pressure control valve is constructed so that when the discharge pressure is large, that is, when the air conditioner is at an initial stage of cooling down, control pressure to be controlled thereby becomes small, so that rapid cooling can be effected. When the discharge pressure is small, that is, when the temperature in the automobile is lowered or the atmospheric temperature (temperature outside the automobile) is low, the control pressure can be made large, so that the deposition of frost on the evaporator fins can be prevented.

According to an aspect of the invention, the variable displacement compressor is provided with lubrication oil recovery means for separating lubrication oil from refrigerant by inertia difference therebetween and effectively returning the separated lubrication oil into the crank chamber.

Further, the variable displacement compressor is constructed so that the reciprocation preventing means, for example, comprising a swash plate and a wobble plate is connected to the driving shaft, for example, through a driving member at a position where an abutment face between the swash plate and the driving member is offset from a plane including a central axis of the driving shaft, whereby the reciprocation preventing means is smoothly moved around the connection.

Still further, the compressor is constructed such that the rotation preventing means has a high durability.

According to an aspect of the invention, a refrigerant passage between the suction port disposed upstream of the pressure control valve and the pressure control valve includes the crank chamber of a large space so that pressure pulsation is damped.

DETAILED DESCRIPTION OF THE INVENTION

Figure 1A:
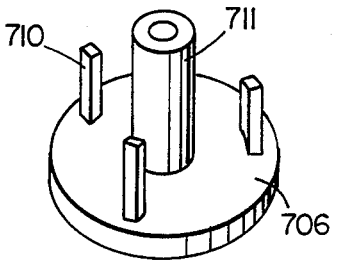
FIG. 1 is a sectional view of a rear cover of a variable displacement compressor according to the invention.

An embodiment of the present invention is described hereunder in detail, referring to the drawings.

Figure 1:
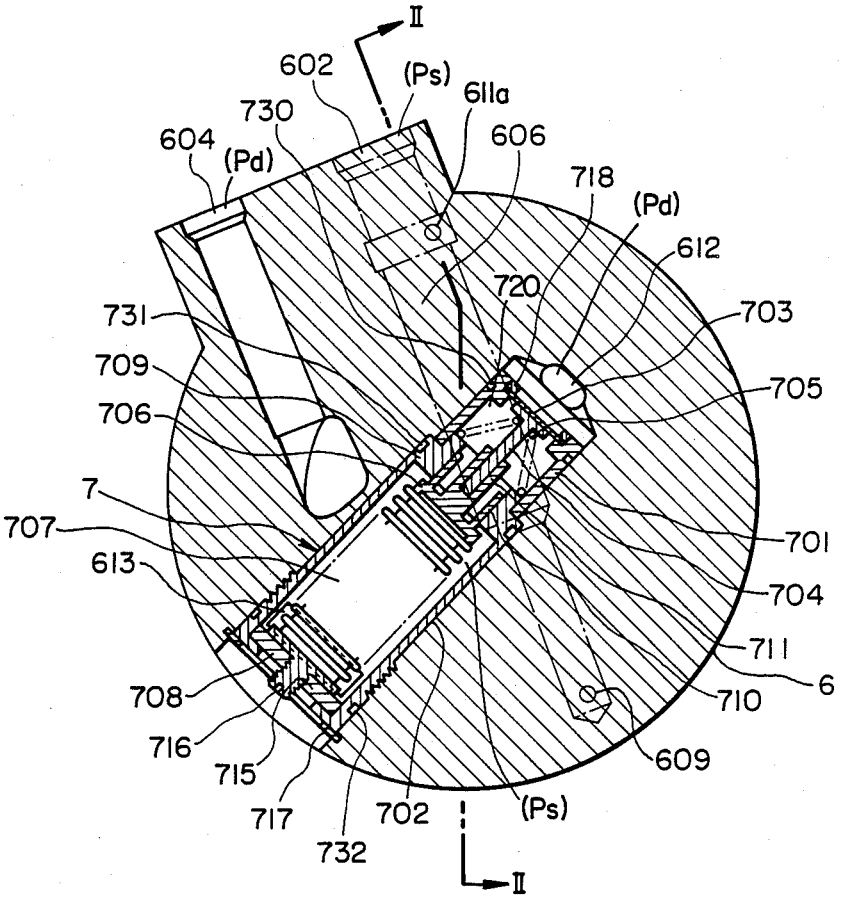
Figure 2:
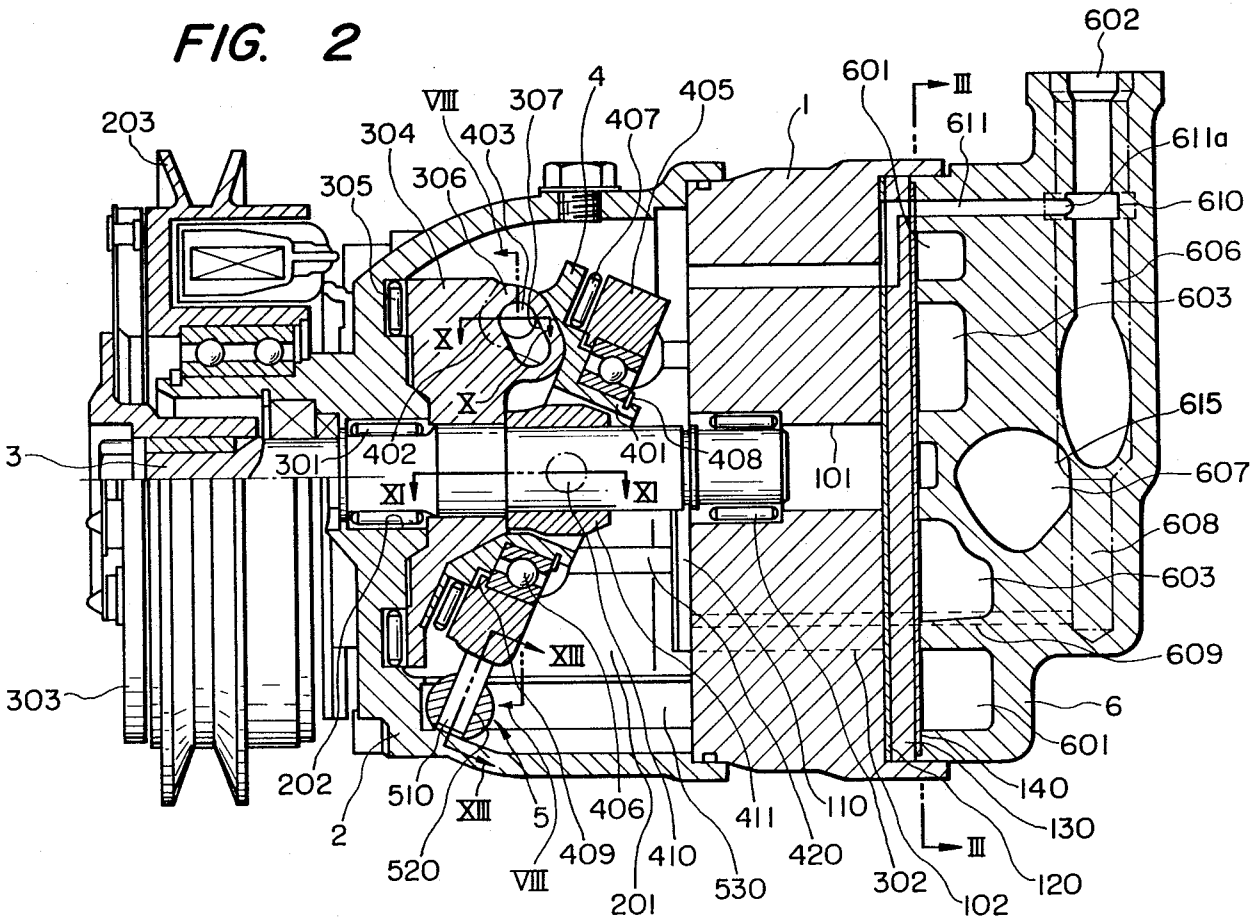
FIG. 2 is a sectional view of the compressor taken along a line II—II of FIG. 1.
Figure 3:
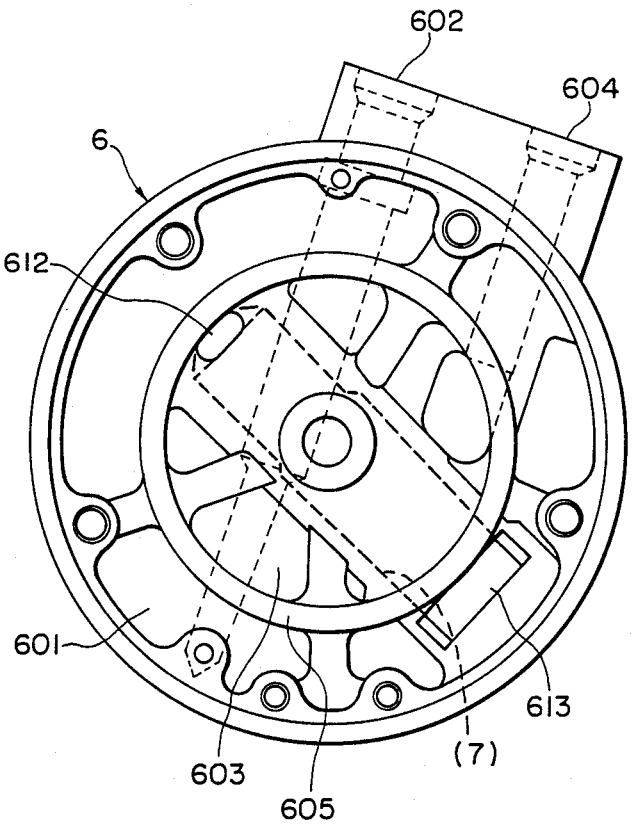
FIG. 3 is a plane view of the rear cover of the compressor shown in FIGS. 1 and 2 and viewed from a line III—III of FIG. 2.

FIGS. 1 to 3 show a variable displacement compressor incorporated with a compressor capacity control valve or a pressure control valve. The variable displacement compressor comprises a cylinder block 1 having a central hole 101 and cylinder bores 102 formed therein and arranged circularly around the central hole 101. In the cylinder bores 102, pistons 110 are inserted. A front cover 2 is hermetically integrated with the cylinder block 1 to form a crank chamber 201 therein and has a hollow boss projecting outwards from one end thereof to support a pulley 203 incorporated with a clutch mechanism. A driving shaft 3 passing through the crank chamber 201 is supported by one end of the front cover 2 and the cylinder block 1 through a bearing 301 fitted in a hole 202 of the front cover and a bearing 302 fitted in the central hole 101 of the cylinder block 1 and has a clutch plate 303 at an outside end thereof to couple with the pulley 203 thereby transmitting driving force from the pulley to the driving shaft 3. A driving member 304 is disposed in the crank chamber 201 and secured to the driving shaft 3 by means of press-fit, fastening pin, etc., so that the driving member 304 can rotate with the driving shaft 3. The driving member 304 is shaped in a disc-like form and supported axially by an interior end of the front cover 2 through a thrust bearing 305 at the peripheral portion. The driving member 304 has a lug 306 at a peripheral portion thereof on a side facing the cylinder block 1. In the lug 306, a cam groove 307 is formed. The cam groove 307 receives a fulcrum pin 403 and guides it along a cam face of the cam groove 307. A swash plate 4, which has a hollow journal portion 401 at a central portion, is disposed to surround the driving shaft 3 and pivotably supported by the fulcrum pin 403 secured by a pair of lugs 402 of the swash plate 4. The swash plate 4 is driven by the lug 306 engaged with the pair of lugs 402 to rotate (the connection of the driving member 304 and the swash plate 4 will be described later in more detail). On the swash plate 4, a wobble plate 405 or piston support is supported through a journal bearing 406 and a thrust bearing 407. The journal bearing 406 is fitted on the hollow journal portion 401 and fastened by a snap ring 408 not to move axially. The wobble plate 405 is restricted to move axially by insertion of an annular projection 409 between the thrust bearing 407 and the bearing 406. The hollow journal portion 401 has a hole (not shown) and is rotatably supported by a pin 410 inserted in the hole and mounted on a sleeve 411 which is slidably mounted on the driving shaft 3, so that the swash plate 4 can rotate around the pin 410 while the pin 410 is axially sliding, with the fulcrum pin 403 being guided by the cam groove 307.

The wobble plate 405 is restricted to rotate by a rotation preventing mechanism 5 comprising a slide pin 510 secured to the wobble plate 405, a ball 520 receiving the slide pin 510 and disposed in a groove 530 formed in the front cover 2. The rotation preventing mechanism 5 is described later in more detail.

The wobble plate 405 has connecting rod receiving portions formed on a side thereof facing the cylinder block 1, and the respective pistons 110 are connected to the wobble plate 405 through connecting rods 420. When the swash plate 4 rotates, the wobble plate 405 is imparted with wobbling motion. The pistons 110 are reciprocated by the wobbling motion of the wobble plate 405.

A suction valve plate 120 in which a suction valve (not shown) is formed, a cylinder head 130, discharge valve (not shown), a suction valve support 140 common to use as packing, and a rear cover 6 are provided on the cylinder block 1 and they are secured to the cylinder block 1 together with the front cover 2 by means of bolts. In the cylinder head, suction ports and discharge ports are provided corresponding to the respective cylinder bores 102.

On the inside of the rear cover 6, a low pressure chamber 601 communicating with a refrigerant suction port 602, and a high pressure chamber 603 communicating with a refrigerant discharge port 604 are formed. As shown in FIG. 3, the low and high pressure chambers 601 and 603 are annular and divided by a partition wall 605. Namely, the low pressure chamber 601 is positioned on the outside of the partition wall 605 and the high pressure chamber 603 on the inside.

The suction port 602 communicates with a refrigerant path 606 extending straight. Midway of the refrigerant path 606, a main branch refrigerant path 607 is branched from the refrigerant path 606. On the downstream side of the branch point of the refrigerant path 606, a narrow straight space 608 is formed. The space 608 communicates with a lower region of the crank chamber 201 through a communication path 609.

The refrigerant path 606 has an expanded path portion 610, which is expanded in cross-sectional area of the refrigerant flow passage, on the upstream side of the branch point. The expanded path portion 610 communicates with an upper region of the crank chamber 201 through a communication path 611. The communication path 609 between the space 608 and the crank chamber 201 is made for transfer of lubrication oil separated from the refrigerant returning from the refrigeration cycle. The refrigerant path 606 is bent sharply at the branch point, so that the lubrication oil is separated from the refrigerant. The separated lubricant oil is transferred to the crank chamber 201. The separation will be described later in detail.

Blow-by gas leaked from gaps between the pistons 110 and the cylinders is exhausted through the communication path 611. The expanded path portion 610 reduces pressure so that the blow-by gas is effectively exhausted through the path 611 which is lower in pressure than is the communication path 609.

As shown in FIG. 1, the pressure control valve 7 or compressor capacity control valve is provided midway of the branch path 607. The pressure control valve 7 comprises an upper case 701, a lower case 702 to which the upper case 701 is secured by means of press-fit, screw, pinching, etc., a diaphragm 703, a stay 704 pressing the diaphragm 703, a spiral spring 705 urging the stay 704 against the diaphragm, a valve body 706, a bellows 707 disposed in the lower case 702, and a set pressure adjuster 708. The diagraphm 703 is disposed on a flange portion of the upper case 701 and hermetically fixed by a ring 718 press-fitted in the upper case 701. An upper side of the diaphragm 703 communicates with the high pressure chamber 603 through a path 612, and a lower side of the diaphragm 703 forms a part of the branch path and communicates with the refrigerant path 606 through a hole 720 formed in a side wall of the upper case 701. The lower side of the diaphragm 703 is pressed upward by the stay 704 urged upward by the spring 705 which is set between a flange of the stay 704 and a flange 709 of the lower case 702. The stay 704 is slidably inserted in a hole having a closed end and formed in a central projection 711 of the valve body 706. The valve body 706 is provided with three or more guide pins 710 projecting upwards and arranged circularly with spacing therebetween and the central projection 711 as mentioned above. The guide pins 710 of the valve body 706 are slidably inserted in the flange 709 of the lower case 702. The lower face of the flange 709 of the lower case 702 forms a valve seat, and an annular flat portion of the valve body 706 facing the valve seat forms a valve face so that an opening between the valve seat and the valve face allows refrigerant to flow from the refrigerant path 606 to the downstream side of the valve body 706 whereby the pressure on the upstream side of the valve body 706 is regulated. The bellows 707 in which generally a spring is incorporated is secured to the lower portion of the valve body 706. The opening of the pressure control valve 7 between the valve body 706 and the valve seat is determined by opposing forces which create balance between a force to comprising the bellows 707 because of pressure acting on the upstream side of the valve body 706 and a resulted force to expanding the bellows 707 because of the pressure of fluid sealed in the bellows and the force of the spring in the bellows. The pressure control valve 7 is constructed such that when the pressure on the upstream side of the valve body 706 is low, the valve opening is made small.

The set pressure adjuster 708 provided in the pressure control valve 7 comprises a plate 715 secured to a bottom of the lower case 702 and a screw member 716. The screw member 716 has a flange portion and a stem portion. The stem portion is threaded and screwed in a screw hole of the plate 715 so that the flange portion presses a lower end of the bellows 707. An initial deformation of the bellows 707 is adjusted by rotating the screw member 716.

The entire pressure control valve 7 is fixed to the rear cover 6 by a snap ring 717.

An o-ring 730 provided between the upper case 701 and the rear cover 6 hermetically seals a high pressure side of the outer side of the upper case 701 from a low pressure side thereof, an o-ring 731 provided between the flange 709 of the lower case 702 and the rear cover 6 hermetically seals pressure on the upstream side of the valve body 706 from pressure on the downstream side thereof, and an o-ring 732 provided between the rear cover 6 and a lower side of the outer periphery of the lower case 702 hermetically seals the upper portion of the o-ring 732 from atmosphere.

Refrigerant entering the compressor at the refrigerant suction port 602 passes between the flange 709 of the lower case 702 and the valve body 706, between the inner wall of the lower case 702 and the outer periphery of the bellows 707, and through a communication path 613, and then flows into the low pressure chamber 601.

In this compressor, pressure in the crank chamber 201 is nearly equal to suction port pressure $P_s$ at the refrigerant suction port 602. The pressure on the downstream side of the control valve 7, that is, the pressure in the low pressure chamber 601 is $P_s'$ and the discharge pressure is $P_d$.

An inclination angle of the swash plate 4 against the driving shaft 3 is determined by balance of two moments about the fulcrum pin 403 one of which is a clockwise moment produced to rotate clockwise the swash plate 4 by force acting on the piston ends on the side of the piston head and the other is an anticlockwise moment produced to rotate anticlockwise the swash plate 4 by force acting on the piston ends on the side of the crank chamber 201. The inclination angle of the swash plate 4 determines the capacity of the compressor.

When atmospheric temperature is high (that is, thermal load is large) and suction port pressure $P_s$ at the refrigerant suction port 602 is high, opening an of the pressure control valve 7 becomes large, so that the low pressure chamber pressure $P_s'$ at the downstream side of the pressure control valve 7 increases. Therefore, discharge pressure $P_d$ also is raised, so that the clockwise moment becomes large and the inclination angle of the swash plate 4, that is, the compressor capacity becomes large. On the other hand, when atmospheric temperature is low (that is, thermal load is small) and the suction port pressure $P_s$ is small, the opening of the pressure control valve 7 becomes small so that the $P_s'$ lowers. Therefore, the discharge pressure $P_d$ also is lowered, so that the clockwise moment become small, and the inclination angle of the swash plate 4, that is, the compressor capacity becomes small. As a result, the $P_s'$ is raised, and $P_s$ can be kept approximately constant by the pressure control valve 7. In other words, a lower limit of $P_s$ can be kept at a set value.

Further, the function of the pressure control valve 7 is explained in detail.

Let the spring constant of the bellows 707, a pressure-acting part area of the valve body 706, and an initial set length of the bellows 707 equal to $k_1$, $A_v$, and xo, respectively, and the valve opening x caused by $P_s$ is given as follows:

$$x = \frac{A_v P_s}{k_1} - xo \tag{1}$$

Let the combined spring constant of the diaphragm 703 and the diaphragm spring 705 and an effective area of the diaphragm 703 equal to $k_2$ and $A_d$, respectively, and a lift y caused by $P_d$, $P_s$ and $k_2$ in a direction in which the valve is opened is given as follows:

$$y = \frac{Ad}{k_2}(P_d - P_s) - yo \tag{2}$$

Here, when $x \geqq y$, lift l of the valve 7 is as follows:

$$l = x$$

When $x < y$, the lift is as follows:

$$l = x + \frac{k_2}{k_3}(y - x)$$

wherein $k_3 = k_1.k_2/(k_1 + k_2)$.

Figure 4:
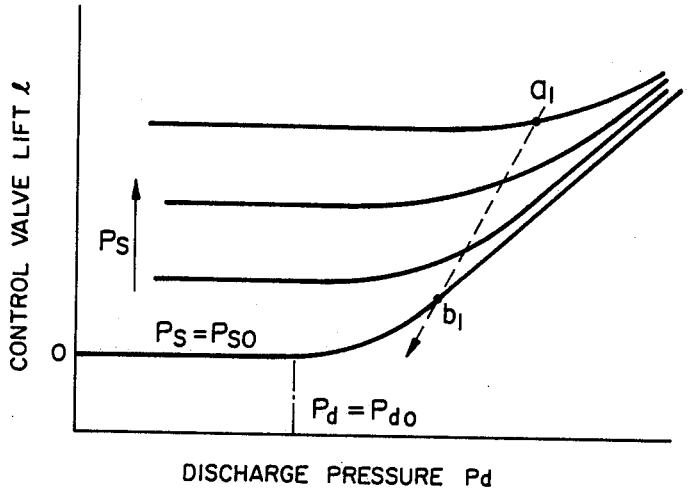
FIG. 4 is a graphical illustration showing characteristics of valve lift on a pressure control valve provided in the variable displacement compressor according to the present invention.

In FIG. 4, the lift l of the pressure control valve 7 under $P_d$ when the lift l is set zero under $P_d = P_{do}$ and $P_s = P_{so}$ is shown with $P_s$ used as a parameter, wherein the discharge pressure $P_{do}$ is a pressure at the time that discharge pressure compensation control starts, that is, when the discharge pressure $P_d$ starts to influence the valve body lift l, and the suction pressure $P_{so}$ is a target pressure of the $P_s'$. As shown in FIG. 4, $l=0$ under $P_s = P_{so}$ and $P_d < P_{do}$. When $P_s$ is higher than $P_{so}$, the lift l becomes larger, and in addition to this, the lift l becomes larger as $P_d$ becomes larger.

Figure 5:
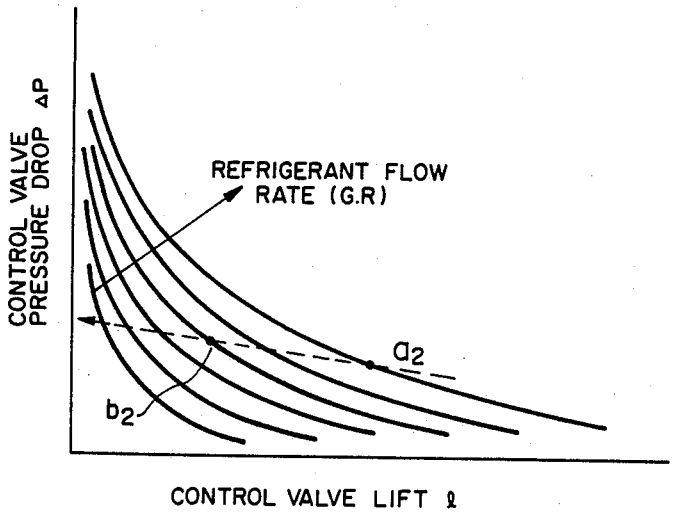
FIG. 5 is a graphical illustration showing pressure differential characteristics of the pressure control valve.

In FIG. 5, an amount of pressure drop $\Delta P$ by the pressure control valve 7 to the valve lift l is shown with refrigerant flow rate used as a parameter. The larger the valve lift l and the less the refrigerant flow rate, the smaller the pressure drop $\Delta P$ becomes.

In FIGS. 4 and 5, a change in the valve lift l and pressure drop $\Delta P$ by the pressure control valve 7 when cooling down is effected under a high atmospheric temperature (thermal load is large) are shown by dotted lines ($a_1$-$b_1$), ($a_2$-$b_2$). When the atmospheric temperature is high, the discharge pressure $P_d$ increases and reaches a point $a_1$ in 1 and 2 minutes after starting of the compressor. As a temperature in the car interior decreases, the discharge pressure $P_d$ decreases gradually as shown by the dotted line ($a_1$-$b_1$) and reaches a point $b_1$. Meanwhile, the valve lift decreases gradually. However, since $P_d > P_{do}$, a pressure at the point $b_1$ does not become zero.

On the other hand, at the start of the compressor, an expansion valve (not shown) in the refrigeration cycle is opened and a flow rate of the refrigerant is large. The flow rate decreases as the temperature in the car interior lowers. Therefore, the valve lift decreases from a point $a_2$ to a point $b_2$. However, a change in the valve lift is small because the valve lift is compensated with the discharge pressure $P_d$. Accordingly, pressure drop $\Delta P$ does not decrease so much. Namely, the pressure differential to reduce the inclination angle of the swash plate 4 is small, which means that the compressor runs with a large inclination angle of the swash plate 4 (under a large capacity). When the atmospheric temperature is low and $P_d$ is less than $P_{do}$, the valve lift is not compensated by the discharge pressure $P_d$, so that the pressure control valve 7 has the same characteristics as a pressure control valve which is not provided with the compensation function by discharge pressure $P_d$.

Figure 6:
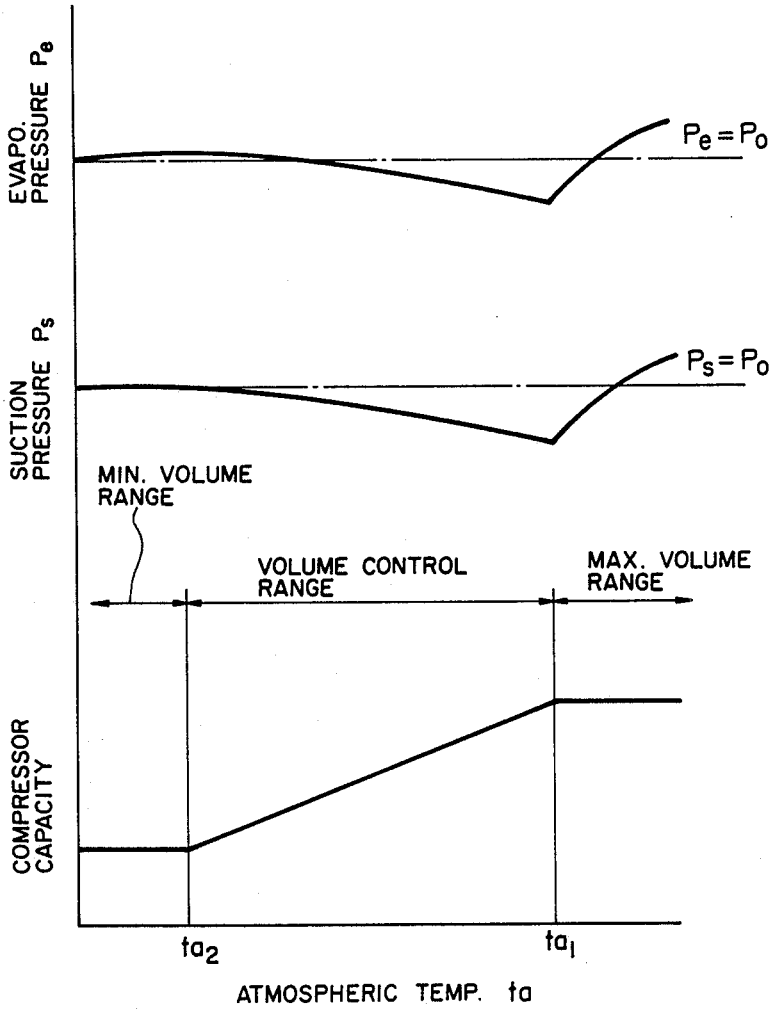
FIG. 6 is a graphical illustration showing pressure control characteristics to atmospheric temperature of the compressor.

Pressure control characteristics to atmospheric temperature $t_a$ in the above-mentioned pressure control valve 7 having a compensation function by the discharge pressure $P_d$ (hereunder called as $P_d$ compensation function) are shown in FIG. 6. In FIG. 6, when the atmospheric temperature $t_a$ changes under a constant rotation speed of the compressor, the compressor capacity becomes the maximum at an atmospheric temperature $t_a$ higher than $t_{a1}$. Further, when the atmospheric temperature $t_a$ is less than $t_{a2}$, the compressor capacity becomes minimum. At an intermediate temperature, the compressor capacity changes nearly in proportion to the atmospheric temperature.

In case the atmospheric pressure $t_a$ is less than $t_{a2}$, the discharge pressure $P_d$ is much less than $P_{do}$, so that in the refrigeration cycle using R-12 as refrigerant, evaporation pressure $P_e$ is necessary to satisfy the following:

$$P_e \geqq 2.05 \text{ kg/cm}^2\text{g} > P_o$$

since frost adheres to evaporator fins when the evaporation pressure $P_e$ is less than 2.05 kg/cm$^2$g, wherein the pressure $P_o$ is an evaporation pressure $P_e$ of freezing, namely, the freezing is effected under a lower pressure than the pressure $P_o$. Under such a condition, the flow rate of the refrigerant is small, so that $P_o$ equals to 2.0 kg/cm$^2$g, taking an account of the passage loss and if the passage loss between the evaporator and the compressor is 0.05 kg/cm$^2$g. Therefore, the suction port pressure $P_s$ of the compressor is as follows:

$$P_s \geqq P_o = 2.0 \text{ kg/cm}^2\text{g}$$

When the atmospheric temperature is high and $P_d \geqq P_{do}$, for example, $P_d = 10$ kg/cm$^2$g or more, frost does not deposit on the evaporator fins if the following is satisfied because the thermal load is large:

$$1.90 \leqq P_e < 2.05 \text{ kg/cm}^2\text{g}$$

In this case, the flow rate of the refrigerant is large and the passage loss also is large so that the suction port pressure $P_s$ is set to more than 1.70 kg/cm$^2$g. When the atmospheric temperature further rises, and reaches higher than $t_{a1}$, the compressor is operated at the maximum capacity. However, under such a condition the compressor runs short of capacity, in spite of the maximum capacity and $P_e$ and $P_s$ increases according to the rise of the atmospheric temperature $t_a$.

Figure 7:
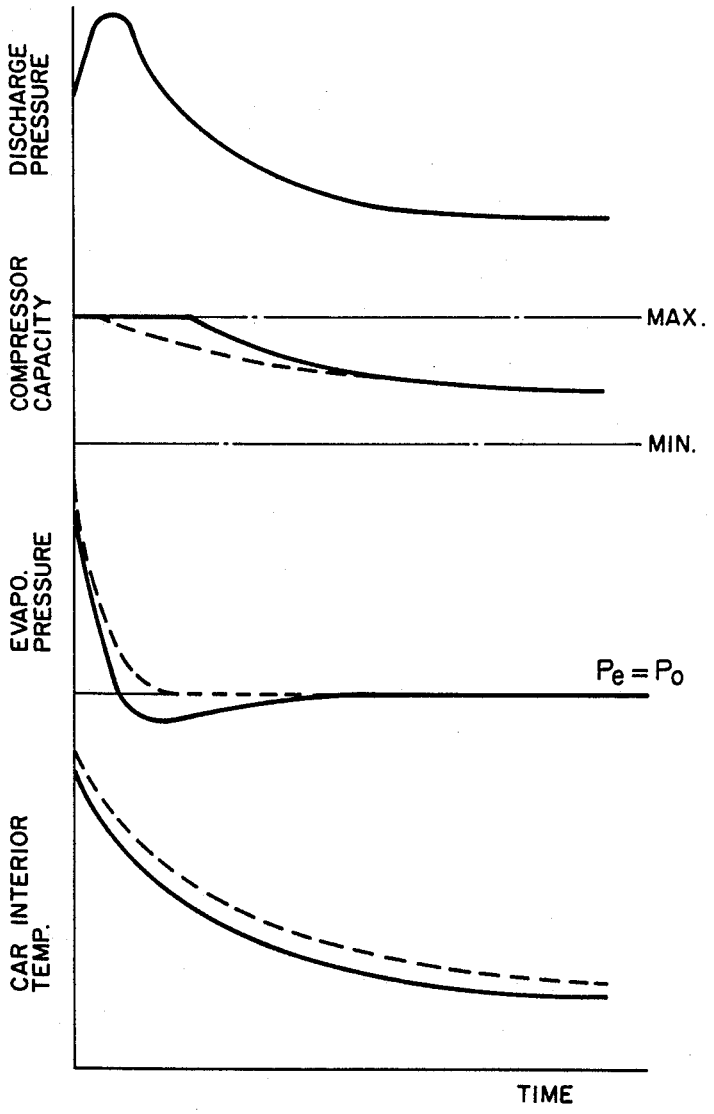
FIG. 7 is a graphical illustration showing cooling down characteristics in a refrigeration cycle incorporated with the variable displacement compressor according to the invention.

FIG. 7 shows cooling down characteristics under conditions that atmospheric conditions (temperature, moisture, sun shine quantity, etc.) and car speed are kept constant. In FIG. 7, solid lines show characteristics of the pressure control valve with the $P_d$-compensation function, and broken lines characteristics of a pressure control valve without the $P_d$-compensation function. With respect to the discharge pressure $P_d$, there is little difference between both pressure control valves, however, with respect to the evaporation pressure $P_e$, in the pressure control valve with the $P_d$ compensation function, since the valve lift is large according to the characteristic shown in FIG. 4 in case of the discharge pressure $P_d$ being high, the pressure drop by the control valve is small, so that the evaporation pressure is lower than $P_o$. Therefore, the compressor capacity is large and the car interior temperature is decreases. $P_D$ lowers as the car inside temperature lowers, whereby $P_e$ in both the compressors becomes equal. As a result, both the compressors have the same capacity. However, with respect to the car interior temperature, difference in cooling effect in an initial stage of cooling down is kept thereafter without change, so that the pressure control valve with $P_d$ compensation function controls the compressor and the car interior temperature is lowered.

The pressure control valve 7 according to the present invention does not introduce the discharge gas of high pressure into the suction side, so that efficiency of the compressor is not decreased. Further, when the swash plate 4 is inclined, even if the atmospheric temperature becomes 0° C. and the discharge pressure $P_d$ becomes 2.5–2.7 kg/cm$^2$g, the pressure differential of about 3 kg/cm$^2$g ($P_s = 2.0$ kg/cm$^2$g and $P_s' = -1$ kg/cm$^2$g) at maximum is obtained at the pressure control valve. The pressure differential is larger than a pressure differential necessary to control the inclination angle of the swash plate 4, so that the inclination angle can be controlled under any operational conditions.

Further detailed explanation is given below with respect to lubrication of the compressor. The lubrication oil enclosed in the crank chamber 201 flows out into the refrigeration cycle during any operational conditions together with the blow-by gas. In order to maintain constant good lubrication of the compressor, it is necessary to effectively return lubrication oil entering the compressor with the refrigerant from the refrigeration cycle into the crank chamber 201. Therefore, a mechanism to separate lubrication oil from the refrigerant and a mechanism to recover the separated lubrication oil into the crank chamber 201 are necessary.

According to the invention, for the separation to take place, the difference in inertia between the lubrication oil and refrigerant is used. The flow direction of the refrigerant lubricating oil returned to the compressor is sharply changed at the branch point of refrigerant path 606. At this time, since the lubrication oil flowing with the refrigerant has a larger inertia than the refrigerant alone, the lubrication oil travels in a straight line, with the refrigerant following the flow direction, whereby the lubrication oil is separated and stored in the space 608. In order to return the separated lubrication oil into the crank chamber 201, a pressure differential between the pressure in the crank chamber 201 and the total pressure of the refrigerant flowing in the refrigerant path 606 is utilized. Therefore, the lower the pressure in the crank chamber 201, the larger the flow rate of the lubrication oil into the crank chamber 201 from the space 608. The pressure $P_i$ in the space 608 is determined by the total pressure of the refrigerant flowing in the the refrigerant path 606, that is, by the static pressure $P_s$ of the refrigerant and the dynamic pressure $P_v$ as follows:

$$P_i = P_s + P_v = P_s + \gamma V^2/2g \quad (3)$$

The static pressure $P_s$ is determined according to the operational conditions of the refrigeration cycle, and the larger the specific weight $\gamma$ and the flow rate v of the refrigerant at the same position, the larger the static pressure $P_i$.

On the other hand, the pressure $P_c$ in the crank chamber 201 changes according to an opening position of the communication path 611, the cross-sectional area of the communication path 611, an amount of blow-by gas in the crank chamber 201, etc. Of those parameters, it is desirable that the amount of blow-by gas be as small as possible in order to raise the performance of the compressor. The smaller the amount of the blow-by gas, the more the pressure in the crank chamber 201 can be lowered. Further, in order to lower the pressure $P_c$ in the crank chamber 201, expansion of the cross-sectional area of the communication path 611, and the position and the shape of the opening of the communication 611 on the side of the refrigerant path 606 are particularly important factors. The cross-sectional area of the communication path 611 is determined by an amount of the blow-by gas. However, in general, the path is designed so that the flow rate in the communication path 611 becomes less than 1–2 m/s, whereby the expansion of the communication path area is limited. Therefore, in order to further lower the pressure in the crank chamber 201, it is necessary to position the opening end of the communication path 611 at a position such that the pressure is as low as possible or to lower the pressure in the opening end portion 611*a* of the communication path 611. On the other hand, in the variable displacement compressor, from the point of view of capacity control, the pressure in the crank chamber 201 is kept at the pressure of the refrigerant suction port 602. Therefore, it is necessary that the opening end portion 611*a* of the communication path 611 is necessary be disposed upstream of the pressure control valve 7 in the refrigerant path 606, and the opening end portion 611*a* can not be disposed at any other portions such as, for example, at the low pressure chamber 601. Therefore, the expanded path portion 610 is provided midway of the refrigerant path 606, and the pressure is partially lowered at the expanded path portion 610 by separating the refrigerant flow thereat. The pressure in the crank chamber 201 is further lowered by disposing the opening end portion 611*a* of the communication path 611 at the expanded path portion 610. In general, a pressure drop $\Delta P_s$ in a sharply expanded flow path is given as follows:

$$P_s = \zeta \frac{V^2}{2g} \quad (4)$$

wherein v is a flow rate in the refrigerant path 606; , $1-(A_1/A_2)^2$; $A_1$, the cross-sectional area of the expanded path portion 610; and $A_2$, the cross-sectional area of the refrigerant path 606. Therefore, the pressure $P_{ou}$ of the opening end portion 611*a* of the communication path 611 is as follows:

$$P_{ou} = P_s - \Delta P_s \quad (5)$$

On the other hand, the pressure at an inlet of the communication path 611, that is, the pressure $P_c$ in the crank chamber 201 is as follows.

$$P_c = P_s - \Delta P_s + \Delta P_L \quad (6)$$

wherein $P_L$ is passage loss in the communication path 611. An amount of the refrigerant flowing into the crank chamber 201 through the communication path 609 for oil is negligible compared with an amount of blow-by gas, so that the $P_L$ is determined by the amount of the blow-by gas. Therefore, the lubrication oil in the space 608 flows into the crank chamber 201 by the following pressure differential $\Delta P$ which is difference between $P_i$ and $P_c$ expressed by the equations (3) and (6):

$$P = \frac{\gamma V^2}{2g} + \Delta P_s - \Delta P_L \quad (7)$$

The flow rate of the blow-by gas is about 1–2 m/s, so that $\Delta P_L$ is nearly equal to zero. Therefore the pressure differential $\Delta P_L$ is as follows:

$$\Delta P_L = \frac{\gamma V^2}{2g} + \Delta P_s \quad (8)$$

The lubrication oil in the space 608 is forced to flow into the crank chamber 201 by the sum of the dynamic pressure $\gamma V^2/2g$ of the refrigerant and pressure drop $\Delta P_s$ of the expanded path portion 610. Thus, in the above-mentioned mechanism for recovering the lubrication oil, since in case of a large thermal load, that is, in case of a large flow rate of the refrigerant and a high discharge port pressure $P_d$, the amount of the blow-by gas and the amount of the lubrication oil flowing into the crank chamber 201 together with the blow-by gas are relatively large. Further, the pressure differential $\Delta P_L$ according to the equation (8) also is large, so that the lubrication oil forcibly separated and stored in the space 608 is returned in sufficient quantities into the crank chamber 201.

When the thermal load is small, the flow rate of the refrigerant is small and the discharge pressure $P_d$ is low. In this case, an amount of blow-by gas is small and lubrication oil flowing into the crank chamber 201 together with the blow-by gas decreases. However, the lubrication oil forcibly separated during passage through the refrigerant path 606 and stored in the space 608 is returned into the crank chamber 201. Additionally, even if lubrication oil in the crank chamber 201 flows out together with the blow-by gas, the lubrication oil is separated from the refrigerant at the refrigerant path 606, and returned into the crank chamber 201, so that the compressor can be lubricated sufficiently and preventing from incurring a reduced durability thereof.

In the compressor used for a refrigeration cycle wherein a sufficient flow rate of the refrigerant is maintained, it is not necessary to provide an expanded path portion as shown by 610 in the refrigerant path 606 because dynamic pressure is large.

The connection between the driving member 304 and the swash plate 4 is described further in detail referring to FIGS. 8 to 12.

Figure 8:
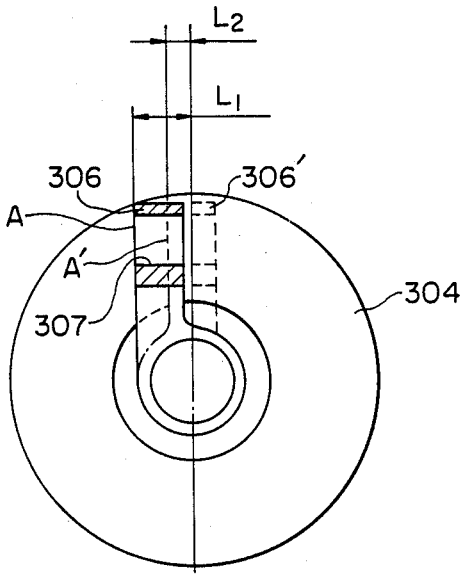
FIG. 8 is a sectional view taken along a line VIII—VIII of FIG. 2.

In FIG. 8, the lug 306 is provided in the driving member 304 so that the center of the lug 306 is offset in the rotating direction of the shaft 3 from a center line passing the axis of the driving shaft 3. An abutment A between the lug 306 and the lugs 402 of the swash plate 4 is more offset than an abutment A' of a conventional lug 306'; namely $L_1$ is larger than $L_2$.

Figure 9:
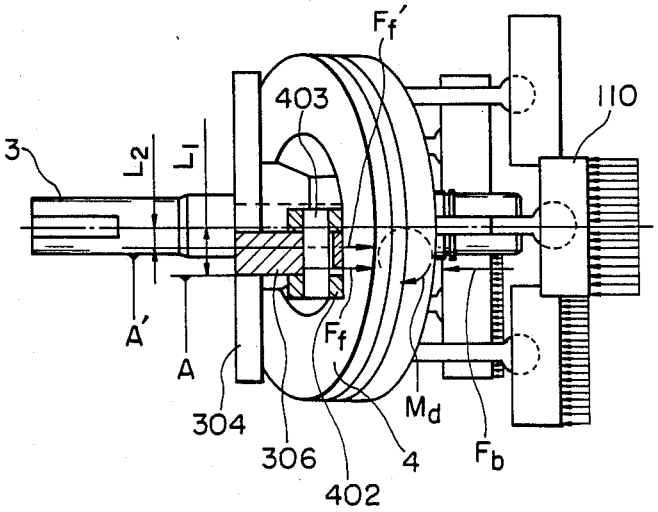
FIG. 9 is a perspective view of a variable stroke mechanism of FIG. 2.

In FIG. 9 showing a variable stroke mechanism taken out of the compressor, the pistons 110 disposed under the center line are under compression stroke. The pressure acting on the pistons 110 on the piston head side is larger than the pressure (the pressure in the crank chamber 201) on the backside of the pistons and the pressure differential therebetween acts leftwards as shown by arrows. The piston on which the longest arrows act is near the final stage of the compression stroke, and the above-mentioned pressure differential is larger. On the other hand, the pistons disposed on the upper side of the center line are under suction stroke, and the pressure acting on the piston heads of those pistons is nearly equal to the pressure $P_s$ at the suction port 602, that is, the pressure acting on the backside of the pistons in the crank chamber 201 under a high thermal load without stroke control by the pressure control valve 7, and the pressure differential therebetween is substantially zero. The acting position or point of a resultant of the pressure differentials generated on all the pistons through compression is shown by an arrow $F_b$.

Figure 12:
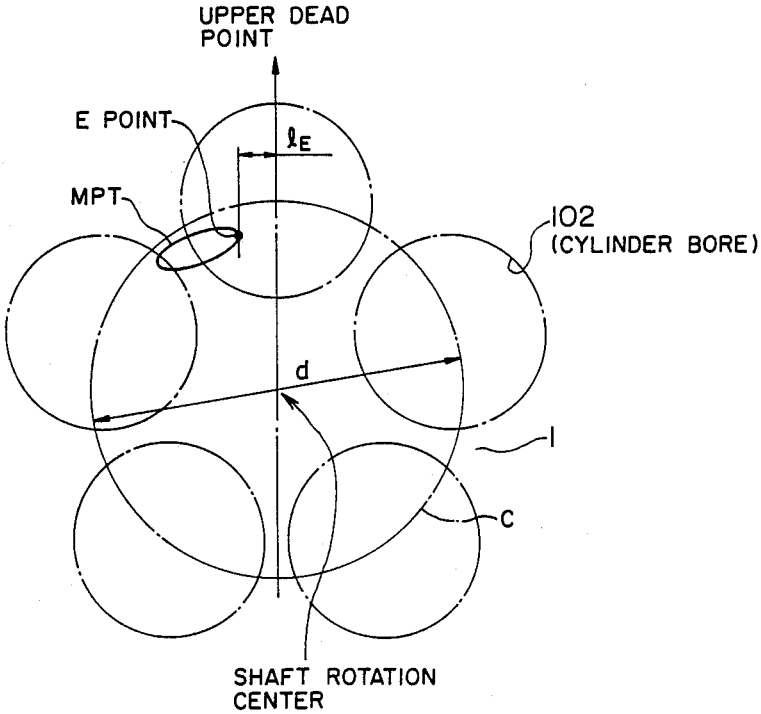
FIG. 12 is a graphical illustration for explaining trace of acting point of resultant of compression reaction acting on the compressor.

The acting point of the resultant of the pressure differential which is precisely calculated on the five cylinders is shown in FIG. 12. In FIG. 12 showing the acting position and cylinder bore arrangement in a rotation coordinate system which rotates together with the driving shaft 3, the cylinder bores 102 are arranged on a circle C of a diameter d. The upper dead center or point is upwards of the drawing. The upper dead center moves together with rotation of the driving shaft 3, but since FIG. 12 is expressed in the rotation coordinate system, the upper dead center is always upwards.

The resultant of the pressure differential acts at a leftward and upward position of the FIG. 12 as explained previously, however, in practice, the acting point moves periodically on the closed circle (moving point trace) MPT with rotation of the shaft 3. The period is expressed 360°/n by rotation angle, wherein n is the number of the cylinder bores 102. This periodic movement of the acting point of the resultant of the pressure differential occurs because according to rotation of the driving shaft 3, the positions of the respective pistons 110 and the pressure differential acting on the pistons change periodically relative to the upper dead center direction with a period of 360°/n. Further, the closed circle MPT which is a moving point trace of the acting position of the resultant of the pressure differential changes according to the operational conditions, that is, according to the suction port pressure $P_s$ and the discharge pressure $P_d$, and FIG. 12 shows the result of the calculation on the most severe operational conditions (durability test conditions), that is, $P_d$ of 30 kg/cm$^2$g and $P_s$ of 2 kg/cm$^2$g.

Further, in addition to the acting point of the resultant of the pressure differential moving on the closed circle, the magnitude of the resultant pressure differential changes and becomes maximum around a point E. A deviation le of the point E from the upper dead center direction is about 7.5 mm when the diameter d of the circle on which the cylinder bores are arranged is 70 mm, and the deviation ratio to the radius (d/2) of the circle C is about 22%.

Figure 10:
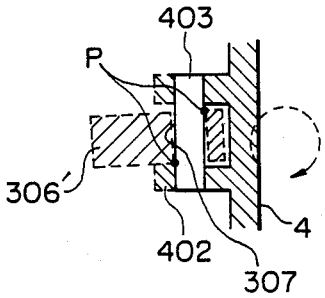
FIG. 10 is a sectional view taken for explanation along a line X—X of FIG. 2.
Figure 11:
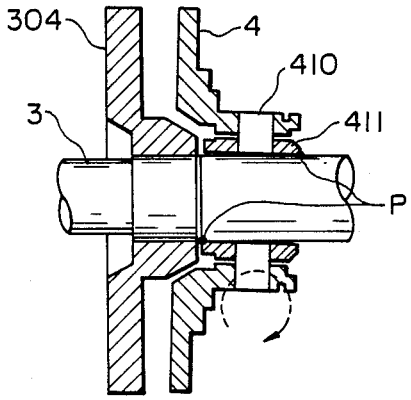
FIG. 11 is a sectional view taken for explanation along a line XI—XI of FIG. 2.

Referring back to FIGS. 8 and 9, the conventional lug 306' shown by dotted line is not offset, so that the abutment face A' is closer to the center than the resultant $F_b$ of the compression reaction. Therefore, supporting force $F_f'$ from the lug 306' acts on an end portion, that is on the abutment face A' and forms a couple with the force $F_b$ to generate moment $M_d$ which is shown by a dotted line. In order to support the moment $M_d$, gouged points P are formed between the cam face 307 and the pin 403 as shown in FIG. 10 or between the driving shaft 3, the sleeve 411, the pin 410 and the swash plate 4, whereby durability of the each part and reliability on smooth operation of the variable stroke mechanism are lowered.

On the contrary, the lug 306 of the driving member is offset in the rotation direction such that the abutment face A is disposed more outside from the center line than the resultant compression reaction $F_b$, and the supporting force $F_f$ from the lug 306 acts just on the backside of the resultant compression reaction $F_b$ within the cam face 307. The forces $F_b$ and $F_f$ do not cause the swash plate 4 to produce a moment.

An amount of the offset $L_1$ of the abutment A from the driving shaft axis is desirable to be at least more than the deviation $l_e$ of the point E from the upper dead center direction, whereby when $F_b$ is largest, no moment is not produced on the swash plate 4. The following offset amount $L_{off}$ of the abutment A is desirable:

$$L_{off} > d/2 \times 0.22$$

The rotation preventing mechanism 5 is described further in detail referring to FIGS. 13 to 16.

Figure 13:
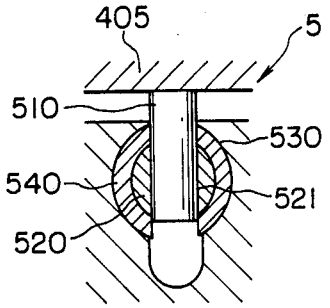
FIG. 13 is a sectional view taken along a line XIII—XIII of FIG. 2.
Figure 14:
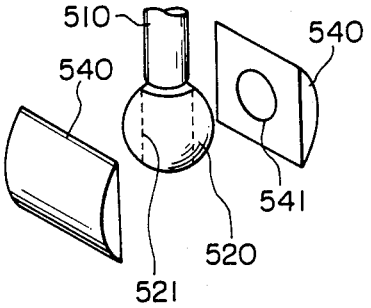
FIG. 14 is a perspective view of disassembled parts shown in FIG. 13.

In FIGS. 13 and 14, the side pin 510, which is secured to the wobble plate 405, is slidably inserted in a cylindrical hole 521 of the ball 520. The ball 520 is sandwiched by a pair of shoes 540 to be rotatable in the shoes 540. Each of the shoes has a shape which is made by dividing a rod into two halves. In the inner surface of the each shoe a spherical concave portion 541 is formed to receive the ball 520. The pair of shoes 540 sandwiching the ball 520 has an outer cylindrical surface and is slidably inserted in the cylindrical groove 530 of the front cover 2.

In this construction of the rotation preventing mechanism 5, the shoes 540 holding the ball 520 effect reciprocation in the cylindrical groove 530 in the axial direction during one rotation of the driving shaft 3. At the same time, the ball 520 permits reciprocation on the slide pin 510. As a result, the wobble plate 4 carries out one cycle of wobbling motion during one rotation of the driving shaft 2. The pistons 110 in the cylinder bores 102 reciprocates once to effect suction and compression of the refrigerant.

This prior art of this rotation preventing mechanism is disclosed in U.S. Pat. No. 4,297,085 in which for example, a guide pin is provided in casing sections in parallel to a driving shaft, a ball is mounted on the guide pin so as to move slidably along the guide pin, a pair of shoes sandwiching the ball, and a pair of radially extending guides are provided in a wobble or socket plate to guide the shoes. In this construction, the guides of the wobble plate move both in a direction of the guide pin and in a perpendicular direction (radial direction) to the guide pin, while the ball is sliding on the guide pin and the pair of shoes are sliding on the pair of radially extending guides. The wobble plate swings about a point thereof. If the swinging angle is $2\alpha$ and a distance between the point and the guide pin is L, the ball slides on the guide pin by a distance 2L tan $\alpha$, and the shoes slides on the guides of the wobble plate by $L_1/\cos\alpha-1)$. If $\alpha$ is 30°, ratio of the ball sliding distance to the shoe sliding distance is about 7.5. Therefore, the ball slides on the guide pin much longer than the shoes slide on the guides. In this prior art, a maximum sliding distance portion is a portion where the ball slides on the guide pin. For a position where a sliding distance or speed is large, it is necessary to reduce surface pressure. It is effective to make a sliding face larger. The sliding face between the ball and the sliding pin is a surface of the hole of the ball. Therefore, in order to reduce the surface pressure, it is also necessary to make a ball of large diameter. In view of the construction of the compressor there is a limit to making the size of the ball larger.

On the contrary, is this embodiment of the invention, the ball 520 and the sliding pin 510 are employed for a shorter sliding distance, and the shoes and the cylindrical groove for a larger sliding distance. The sliding distance of the ball 520 and the pin 510 can be reduced to $(1\text{-}\cos\alpha)/2\sin\alpha$ times (1/7.5 times if $\alpha$ is 30°) compared with the sliding distance of the ball and the guide pin of the prior art. Therefore the sliding velocity of the ball also is reduced to 1/7.5 times (in case of $\alpha=30°$), so that a pv value (p: surface pressure, v: velocity) representing sliding characteristics is reduced to 1/7.5 (in case of $\alpha=30°$).

Figure 15:
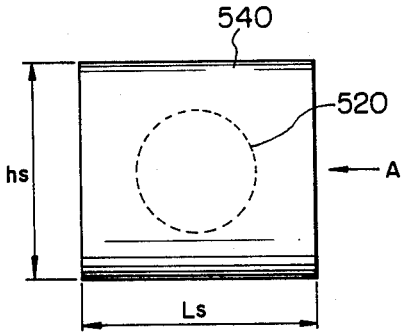
FIG. 15 is a vertical view of a shoe and ball assembly used in the compressor shown in FIG. 2.
Figure 16:
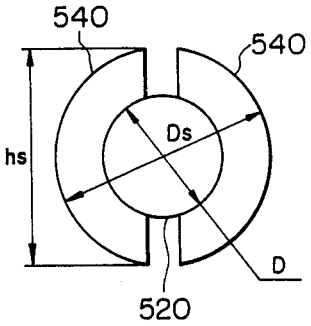
FIG. 16 is a front view of the shoe and ball assembly shown in FIG. 14.

On the other hand, the sliding velocity of the shoes 540 increases to $\sin\alpha/(1\text{-}\cos\alpha)$ times and is the same as one of the ball in the above-mentioned prior art. Referring to FIGS. 15 and 16, since the each shoe 540 is engaged with the outside of the ball 520, the outer diameter $D_s$ of the shoe is larger by the thickness of the shoes than the diameter D of the ball 520, whereby the height $h_s$ of the shoe also can be set sufficiently large. The length $L_s$ of the shoe is not limited by the outer diameter as in the prior art, so that a pressure receiving area $As(=h_s.L_s)$ can be set much larger than a pressure receiving area of the ball. Therefore in a sliding characteristic, i.e., a pv value of the shoe 540 and the cylindrical groove 530, the surface pressure p can be sufficiently reduced because of increase of the pressure receiving area $A_s$. The pv value of the ball 520 and the slide pin 510 can be made equivalent to a Pv valve of the shoe 540 and the cylindrical groove 530, whereby wear resistance and seizure resistance can be improved.

Further the cylindrical groove portion can be made of a material different from the front cover 2 and higher in wear resistance.

Figure 17:
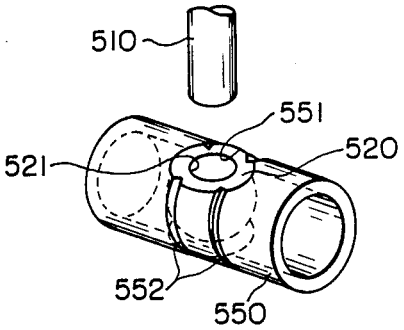
FIG. 17 is a perspective view of a bush used as shoes in the compressor according to the invention.

In view of assembly of the rotation preventing mechanism, a cylindrical bush 550 as shown in FIG. 17 can be employed in place of the pair of shoes 540 as shown in FIG. 16. The bush 550 has a hole 551 formed in which the slide pin 510 can be slidably inserted. In the interior of the bush 550, the ball 520 is enclosed. A plurality of concave portions 552 for positioning the ball 520 are provided in order that the ball 520 is freely rotatable where the axis of the ball hole 521 coincides with an axis of the hole 551 of the bush 550. The concave portions 552 are convex in the inside of the bush 550. Namely, the convex portions for positioning the ball 520 are formed in the bush 550 by rolling, etc. The hole 551 formed in the bush 550 is a slotted hole which is longer in the axial direction. The slotted hole allows the slide pin to incline in the axial direction while the wobble plate is wobbling. This bush 550 makes the assembling of the rotation preventing mechanism easy.

The refrigerant at the suction port 602 is sucked into the cylinders through the refrigerant path, the pressure control valve and the low pressure chamber, and compressed to discharge the compressed gas through the discharge port 604. In this compressor, a space, which can dampen pressure pulsation in the refrigerant path from the suction port 602 to the compression chamber, is only the low pressure chamber 603 formed in the rear cover 6. Where the low pressure chamber is small, large pulsations cause vibration and noise. In order to reduce such vibration and noise, the low pressure chamber is made large, but then the compressor itself becomes larger. Therefore, a large space to accommodate such a large compressor is necessary, and if such space is relatively small, it becomes difficult to effectively or promptly install the large compressor in such a space.

Refrigerant with pressure pulsation is introduced into the compression chamber through the crank chamber 201 so that the pressure pulsation is effectively damped because the crank chamber has a large space.

Figure 18:
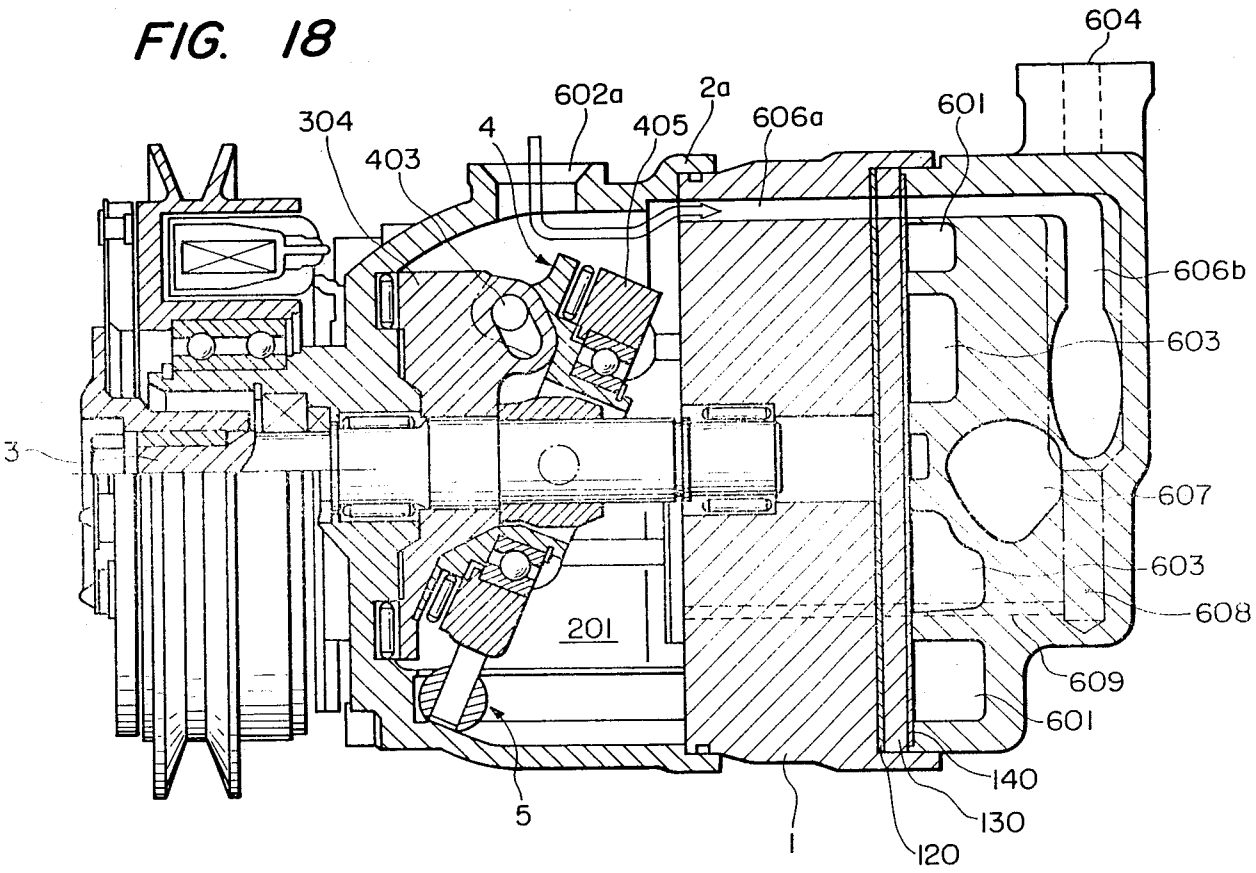
FIGS. 18 to 20 each are a sectional view of a variable displacement compressor of the invention with a modified refrigerant path for introducing refrigerant into compression chamber.

Referring to FIG. 18, there is shown a compressor which is the same as one shown in FIG. 2 except for only the refrigerant path. The compressor is provided with a suction port **602*a* in the front cover 2. The refrigerant is introduced from the suction port 602*a* into the compression chamber formed by the pistons, the cylinder bores, etc. through the crank chamber 201, a horizontal refrigerant path 606*a*, a vertical refrigerant path 606*b*, the control valve (not shown) and the low pressure chamber 603. The pressure pulsation of the refrigerant is damped in a large space of the crank chamber 201. The same reference numerals in FIG. 18 refer to the same parts as in FIGS. 1–3**.

Figure 19:
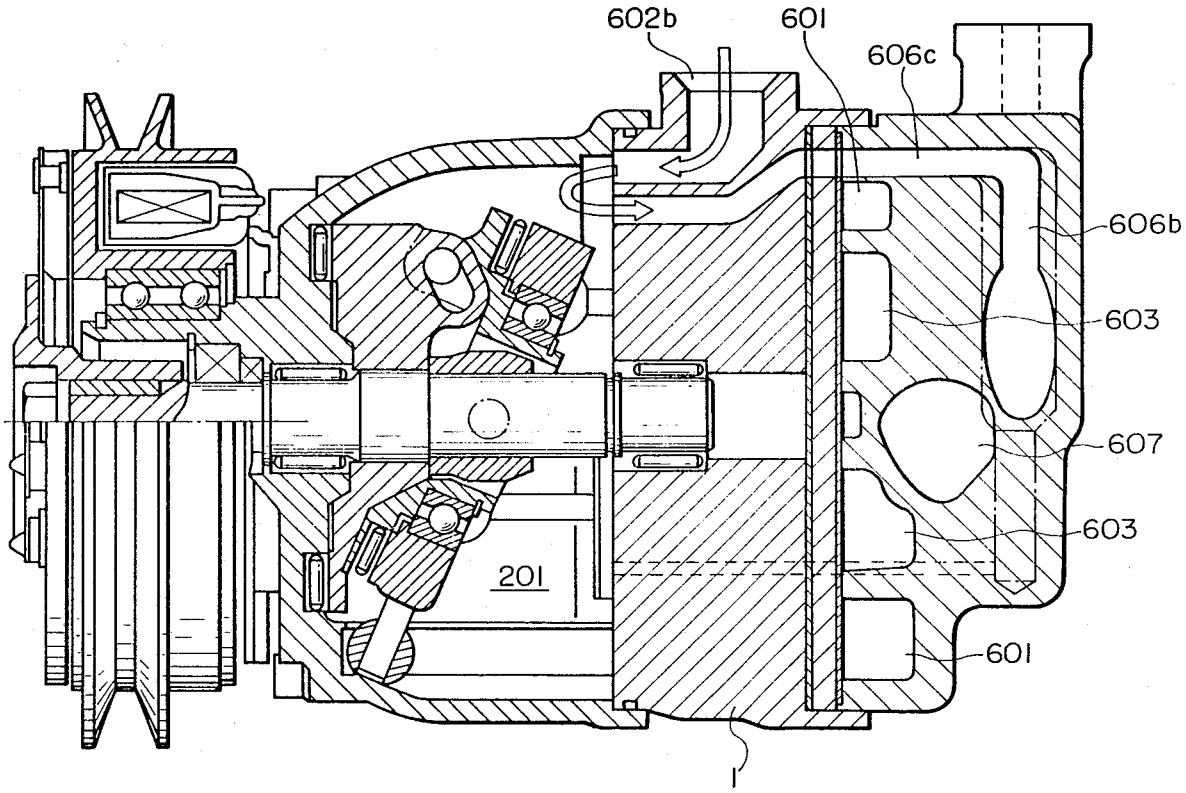

Another pressure pulsation damping mechanism of the compressor is shown in FIG. 19. The compressor is the same as in FIG. 18 except for the refrigerant passage. In the compressor, the suction port **602*b* is formed in the cylinder block, and the refrigerant path 606*c* includes the crank chamber 201 in the midway and communicates with the path 606*b*. The remaining construction is the same as in FIG. 18**.

The pressure pulsation of the refrigerant is damped in the crank chamber 201.

Further, the path **606*c* has a sharply bent portion, so that the lubrication oil is separated from the refrigerant and stored in the crank chamber 201** when the refrigerant flow is bent there.

Figure 20:
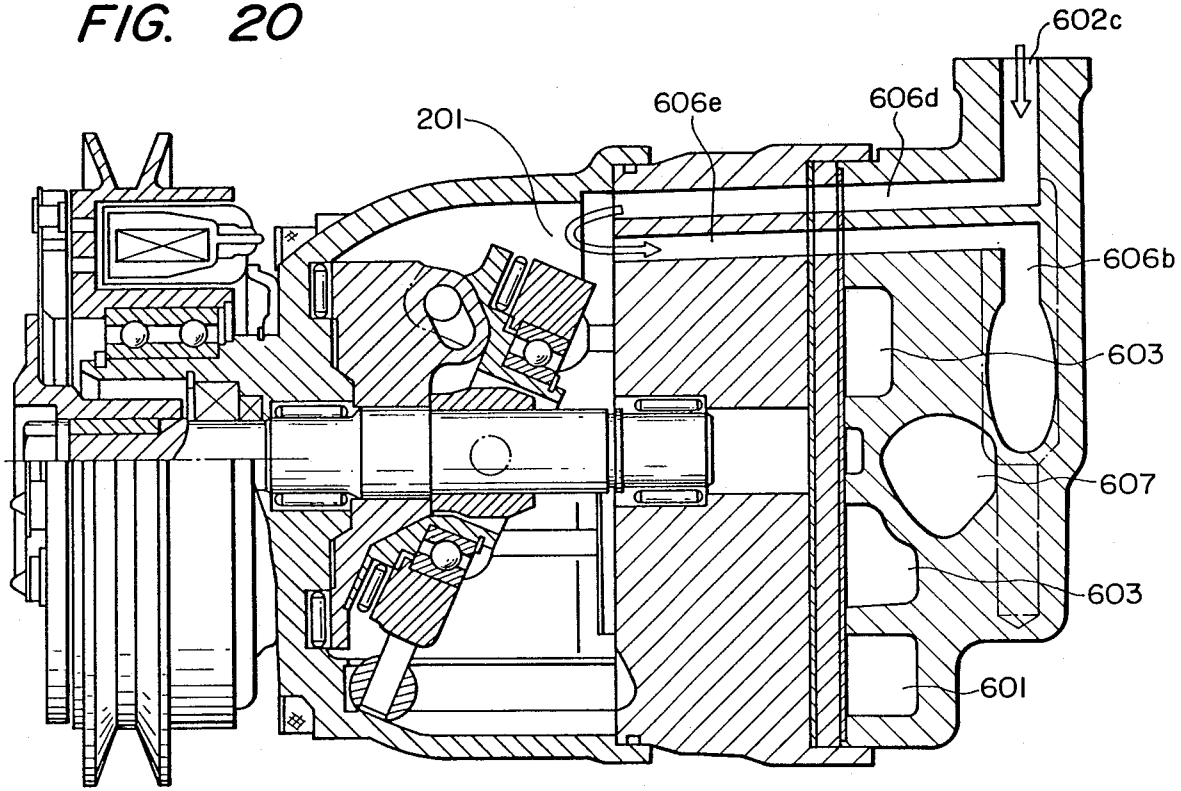

In FIG. 20, another refrigerant passage wherein pressure pulsation can be damped is shown. The passage comprises an refrigerant suction port **602*c*, an upper horizontal path 606*d*, the crank chamber 201, a lower horizontal path 606*e* and a refrigerant path 606*d***.

The refrigerant enters the compressor at the suction port **602*c*, and then is introduced into the cylinder chamber through the paths 606*d*, 606*e*, 606*b*, the pressure control valve (not shown), the main branch path 607, the low pressure chamber 601. This path is long and has a large expanded space portion at the crank chamber 201**, so that low pressure pulsation damping effect is great.

What is claimed is:

1. A variable displacement compressor, comprising:

a plurality of expansible chambers including pistons, said pistons each having a front side end forming a part of said expansible chamber and a back side end;

a driving shaft driven to rotate;

means for converting rotation of said shaft into reciprocation of said pistons, said rotation converting means including means for imparting reciprocation to said pistons, a connection means for connecting said reciprocation imparting means to said driving shaft so that said reciprocation imparting means is driven by said driving shaft while being allowed to incline against said driving shaft, and means for preventing rotation of said reciprocation imparting means driven by said driving shaft so as to allow said reciprocation imparting means to wobble, whereby said pistons are reciprocated;

a housing means for forming a crank chamber enclosing therein said rotation converting means and at least said back side end of said each piston;

a refrigerant suction port through which refrigerant is led to said expansible chambers under suction stroke;

a refrigerant discharge port communicating with said expansible chambers to discharge compressed refrigerant;

a pressure control valve provided to control pressure of refrigerant to be sucked into said expansible chambers;

wherein said pressure control valve has a diaphragm means for increasing a valve opening, when the discharge pressure is high, in response to said discharge pressure thereby to increase an amount of compressed refrigerant discharged out of said expansible chambers to raise the compressor capacity.

2. A variable displacement compressor, comprising:

a plurality of expansible chambers including pistons, said pistons each having a front side end forming a part of said expansible chamber and a back side end;

a driving shaft driven to rotate;

means for converting rotation of said shaft into reciprocation of said pistons, said rotation converting means including means for imparting reciprocation to said pistons, a connection means for connecting said reciprocation imparting means to said driving shaft so that said reciprocation imparting means is driven by said driving shaft while being allowed to incline against said driving shaft, and means for preventing rotation of said reciprocation imparting means driven by said driving shaft so as to allow said reciprocation imparting means to wobble, whereby said pistons are reciprocated;

a housing means for forming a crank chamber enclosing therein said rotation converting means and at least said back side end of said each piston;

a refrigerant suction port through which refrigerant is led to said expansible chambers under suction stroke;

a refrigerant discharge port communicating with said expansible chambers to discharge compressed refrigerant;

a pressure control valve provided to control pressure of refrigerant to be sucked into said expansible chambers;

wherein said pressure control means comprises;

a casing;

a valve seat portion provided inside said casing;

a valve body disposed in said casing so that a part of said valve body faces said valve seat;

a bellows connected to said valve body, said valve body receiving suction pressure from an opposite side to said bellows and changing a valve opening according to said suction pressure so that a controlled pressure is established downstream of said valve body; and a diaphragm means mounted on said casing for receiving discharge pressure, making displacement according to the discharge pressure, and transferring said displacement of said diaphragm means to said valve body on the discharge pressure receiving side thereof when said displacement is large.

3. A variable displacement compressor, comprising:

a plurality of expansible chambers including pistons, said pistons each having a front side end forming a part of said expansible chamber and a back side end;

a driving shaft driven to rotate;

means for converting rotation of said shaft into reciprocation of said pistons, said rotation converting means including means for imparting reciprocation to said pistons, a connection means for connecting said reciprocation imparting means to said driving shaft so that said reciprocation imparting means is driven by said driving shaft while being allowed to incline against said driving shaft, and means for preventing rotation of said reciprocation imparting means driven by said driving shaft so as to allow said reciprocation imparting means to wobble, whereby said pistons are reciprocated;

a housing means for forming a crank chamber enclosing therein said rotation converting means and at least said back side end of said each piston;

a refrigerant suction port through which refrigerant is led to said expansible chambers under suction stroke;

a refrigerant discharge port communicating with said expansible chambers to discharge compressed refrigerant;

a pressure control valve provided to control pressure of refrigerant to be sucked into said expansible chambers under suction stroke in response to refrigerant suction pressure on the upstream side of said pressure control valve and a discharge pressure thereby controlling an amount of compressed refrigerant discharged from said expansible chamber to change the compressor capacity;

a communication means for communicating said crank chamber and the upstream side of said pressure control valve, whereby blow-by gas in said crank chamber is discharged; and means for recovering lubrication oil from the refrigerant including the lubrication oil using inertial difference between the refrigerant and the lubrication oil, wherein said lubrication oil recovering means comprises: a first refrigerant path which is straight and extend downwards from said refrigerant suction port;

a second refrigerant path communicating with said first refrigerant path led to said expansible chambers on the suction side;

a sharply bent portion formed at a connection of said first and second refrigerant paths for separating lubrication oil from refrigerant by inertia differential; and an elongated space extending downward from about said connection of said first and second refrigerant paths, said elongated space storing separated lubrication oil and communicating with said crank chamber.

4. A variable displacement compressor according to claim 3, wherein an expanded path portion is provided in a midway of said first refrigerant path for reducing pressure therein, said expanded path portion communicating with said crank chamber.

5. A variable displacement compressor, comprising:

a plurality of expansible chambers including pistons, said pistons each having a front side end forming a part of said expansible chamber and a back side end;

a driving shaft driven to rotate;

means for converting rotation of said shaft into reciprocation of said pistons, said rotation converting means including means for imparting reciprocation to said pistons, a connection means for connecting said reciprocation imparting means to said driving shaft so that said reciprocation imparting means is driven by said driving shaft while being allowed to incline against said driving shaft, and means for preventing rotation of said reciprocation imparting means driven by said driving shaft so as to allow said reciprocation imparting means to wobble, whereby said pistons are reciprocated;

a housing means for forming a crank chamber enclosing therein said rotation converting means and at least said back side end of said each piston;

a refrigerant suction port through which refrigerant is led to said expansible chambers under suction stroke;

a refrigerant discharge port communicating with said expansible chambers to discharge compressed refrigerant;

a pressure control valve provided to control pressure of refrigerant to be sucked into said expansible chambers under suction stroke in response to refrigerant suction pressure on the upstream side of said pressure control valve and a discharge pressure thereby controlling an amount of compressed refrigerant discharged from said expansible chamber to change the compressor capacity;

a communication means for communicating said crank chamber and the upstream side of said pressure control valve, whereby blow-by gas in said crank chamber is discharged; wherein said reciprocation imparting means comprises a swash plate having a lug and a wobble plate mounted on said swash plate so as to freely rotate relative to said swash plate, and said connection means comprises a driving member secured to said driving shaft and having a portion engaged said lug of said swash plate at an abutment face to rotate said swash plate said abutment face being offset from a plane including a rotation axis of said driving shaft in a rotating direction, and further, wherein said portion of said driving member has a width, and a center of said width is offset from the rotary axis of said driving shaft in the rotating direction.

6. A variable displacement compressor, comprising:

a plurality of expansible chambers including pistons, said pistons each having a front side end forming a part of said expansible chamber and a back side end;

a driving shaft driven to rotate;

means for converting rotation of said shaft into reciprocation of said pistons, said rotation converting means including means for imparting reciprocation to said pistons, a connection means for connecting said reciprocation imparting means to said driving shaft so that said reciprocation imparting means is driven by said driving shaft while being allowed to incline against said driving shaft, and means for preventing rotation of said reciprocation imparting means driven by said driving shaft so as to allow said reciprocation imparting means to wobble, whereby said pistons are reciprocated;

a housing means for forming a crank chamber enclosing therein said rotation converting means and at least said back side end of said each piston;

a refrigerant suction port through which refrigerant is led to said expansible chambers under suction stroke;

a refrigerant discharge port communicating with said expansible chambers to discharge compressed refrigerant;

a pressure control valve provided to control pressure of refrigerant to be sucked into said expansible chambers under suction stroke in response to refrigerant suction pressure on the upstream side of said pressure control valve and a discharge pressure thereby controlling an amount of compressed refrigerant discharged from said expansible chamber to change the compressor capacity;

a communication means for communicating said crank chamber and the upstream side of said pressure control valve, whereby blow-by gas in said crank chamber is discharged; wherein said reciprocation imparting means comprises a swash plate having a lug and a wobble plate mounted on said swash plate so as to freely rotate relative to said swash plate, said connection means comprises a driving member secured to said driving shaft and having a portion engaged said lug of said swash plate at an abutment face to rotate said swash plate said abutment face being offset from a plane including a rotation axis of said driving shaft in a rotating direction, and said abutment face between said lug of said swash plate and said portion of said driving member is offset from a plane including a rotation axis of said driving shaft by more than 22% of a radius of a circle on which cylinder bores of said expansible chambers are arranged.

7. A variable displacement compressor, comprising:

a plurality of expansible chambers including pistons, said pistons each having a front side end forming a part of said expansible chamber and a back side end;

a driving shaft driven to rotate;

means for converting rotation of said shaft into reciprocation of said pistons, said rotation converting means including means for imparting reciprocation to said pistons, a connection means for connecting said reciprocation imparting means to said driving shaft so that said reciprocation imparting means is driven by said driving shaft while being allowed to incline against said driving shaft, and means for preventing rotation of said reciprocation imparting means driven by said driving shaft so as to allow said reciprocation imparting means to wobble, whereby said pistons are reciprocated;

a housing means for forming a crank chamber enclosing therein said rotation converting means and at least said back side end of said each piston;

a refrigerant suction port through which refrigerant is led to said expansible chambers under suction stroke;

a refrigerant discharge port communicating with said expansible chambers to discharge compressed refrigerant;

a pressure control valve provided to control pressure of refrigerant to be sucked into said expansible chambers under suction stroke in response to referigerant suction pressure on the upstream side of said pressure control valve and a discharge pressure thereby controlling an amount of compressed refrigerant discharged from said expansible chamber to change the compressor capacity;

a communication means for communicating said crank chamber and the upstream side of said pressure control valve, whereby blow-by gas in said crank chamber is discharged; wherein said reciprocation imparting means comprises a swash plate having a lug and a wobble plate mounted on said swash plate so as to freely rotate relative to said swash plate, said connection means comprises a driving member secured to said driving shaft and having a portion engaged said lug of said swash plate at an abutment face to rotate said swash plate said abutment face being offset from a plane including a rotation axis of said driving shaft in a rotating direction, and said abutment face between said lug of said swash plate and said portion of said driving member is close to an acting line of an acting point of the resultant of compression pressure acting on said pistons.

8. A variable displacement compressor comprising:

a plurality of expansible chambers including pistons, said pistons each having a front side end forming a part of said expansible chamber and a back side end;

a driving shaft driven to rotate;

means for converting rotation of said shaft into reciprocation of said pistons, said rotation converting means including means for imparting reciprocation to said pistons, a connection means for connecting said reciprocation imparting means to said driving shaft so that said reciprocation imparting means is driven by said driving shaft while being allowed to incline against said driving shaft, and means for preventing rotation of said reciprocation imparting means driven by said driving shaft so as to allow said reciprocation imparting means to wobble, whereby said pistons are reciprocated;

a housing means for forming a crank chamber enclosing therein said rotation converting means and at least said back side end of said each piston;

a refrigerant suction port through which refrigerant is led to said expansible chambers under suction stroke;

a refrigerant discharge port communicating with said expansible chambers to discharge compressed refrigerant;

a pressure control valve provided to control pressure of refrigerant to be sucked into said expansible chambers under suction stroke in response to refrigerant suction pressure on the upstream side of said pressure control valve and a discharge pressure thereby controlling an amount of compressed refrigerant discharged from said expansible chamber to change the compressor capacity;

a communication means for communicating said crank chamber and the upstream side of said pressure control valve, whereby blow-by gas in said crank chamber is discharged.

9. A variable displacement compressor according to claim 8, wherein said refrigerant suction passage includes parallel opposite to each other and said crank chamber at which the refrigerant glow direction is sharply bent, so that pressure pulsation is damped.

10. A variable displacement compressor according to claim 8, wherein said pressure responsive member of said pressure control valve is flexible and deformed in response to the refrigerant discharge pressure.

11. A variable displacement compressor according to claim 8, wherein said rotation preventing means comprises a slide pin secured to said reciprocation imparting means, a ball having a hole and slidably fitted on said slide pin, and a shoe device consisting of a pair of shoe members forming a cylindrical outer surface, rotatably enclosing said ball therebetween and inserted in a cylindrical groove formed in said housing means, said each shoe member having an inner surface of a flat surface with a spherical concave for receiving said ball, whereby said slide pin is movable in a direction of said driving shaft with said shoe member while sliding in said ball.

12. A variable displacement compressor according to claim 11, wherein said show device is a bush having a hole formed in a perpendicular direction to an axis of said bush for receiving said slide pin and projections projecting inside said bush for restricting axial movement of said ball enclosed in said bush.

13. A variable displacement compressor comprising:

a cylinder block having a central hole and a plurality of cylinder bores arranged circularly around said central hole;

a plurality of pistons inserted in said cylinder bores;

a front cover integrated with one side of said cylinder block to form a closed crank chamber;

a driving shaft passing through said crank chamber and rotatably supporting by said front cover and said cylinder block;

a driving member, disposed in said crank chamber secured to said driving shaft to rotate with said driving shaft, and supported by a thrust bearing disposed on said front cover on an opposite side to said cylinder block, said driving member having a lug with a cam groove;

a swash plate having a hollow journal portion surrounding said driving shaft with a gap therebetween and a lug at a peripheral portion, said lug being mechanically connected to said lug of said driving member by a fulcrum pin inserted in said cam groove so that said swash plate is driven by said driving shaft to rotate;

a sleeve freely passing through said hollow journal portion of said swash plate and slidably fitted to said driving shaft, said sleeve being interconnected with said swash plate by a pin so that said swash plate is rotatably about said pin;

a wobble plate mounted on said swash plate through a journal bearing fitted on said hollow journal portion and a thrust bearing disposed between said swash plate and said wobble plate, whereby said wobble plate is rotatable relative to said swash plate, said wobble plate being connected to said respective pistons by connecting rods, so that an inclination of said swash plate and said wobble plate against said driving shaft, which inclination determines the compressor capacity, is determined by differential between a resultant of force applied on said pistons on the crank chamber side and a resultant of force applied on said pistons on the piston head side;

a rotation preventing mechanism including a slide pin secured to said wobble plate, a ball with a hole mounted on said slide pin thereon, and a shoe member rotatably holding said ball and slidably inserted in an axial groove formed in a bottom of said front cover in a parallel direction to said driving shaft, whereby said wobble plate is prevented to rotate and effects wobbling motion while said swash plate is rotating;

a cylinder head construction member disposed on an end of said cylinder block on the opposite side to said crank chamber to form cylinder heads of said cylinder bores;

a rear cover secured to said cylinder block so as to sandwich said cylinder head construction member, said rear cover having low and high pressure chambers separated from each other, refrigerant suction port and discharge ports communicating with said low and high pressure chambers, respectively;

a straight refrigerant passageway formed in said rear cover, communicating with said refrigerant suction port on the upstream side; and having an expanded portion in the midway thereof for reducing pressure of the refrigerant passing therethrough, said expanded portion communicating with an upper side of said crank chamber;

a branch refrigerant passage formed in said rear cover branched from a downstream side of said straight refrigerant passage and communicating with said low pressure chamber, said branch refrigerant passage and said straight refrigerant passage forming a sharply bent portion at a branch point thereof;

a narrow space straightly extending from the downstream side of said straight refrigerant passage; and communicating with a lower side of said crank chamber;

a pressure control valve provided on said branch refrigerant passage for controlling pressure of refrigerant led to said low pressure chamber; said pressure control valve being fitted in a cavity formed in said rear cover and comprising an upper cylindrical case having a hole on a side wall thereof;

a lower cylindrical case secured to said upper case and having a flange at an upper portion thereof;

a diaphragm hermetically mounted on an upper end of said upper case, and an outside of said diaphragm communicating with said high pressure chamber;

a stay having a flange portion engaged with said diaphragm and a stem portion extending perpendicularly from said flange portion of said stay;

a spring disposed in said upper case supported by said flange of said lower case and said flange portion of said stay to urge said stay upwards to press said diaphragm;

a valve body engaged with said flange of said lower case to provide a valve opening between said valve body and said flange, a space defined by said upper case between said diaphragm and said valve body communicating with said refrigerant suction port through said hole, and a space defined by said lower case on the downstream side of said valve body communicating with said low pressure chamber through a hole made in a side wall of the lower case, said valve body being displaced by suction pressure on the upstream side of said valve body to change said valve opening and by discharge pressure acting on said diaphragm when the discharge pressure is higher than a predetermined valve, in addition to said suction pressure acting on said valve body;

a bellows disposed in said lower case and secured to a lower side of said valve body; and an initial set pressure adjusting mechanism mounted on the lower side of said bellows.

* * * * *